US006019080A

United States Patent [19]

LaGrone

[11] Patent Number: 6,019,080

[45] Date of Patent: Feb. 1, 2000

[54] PORTED PISTON

[76] Inventor: John T. LaGrone, P.O. Box 1904, Vinton, La. 70668

[21] Appl. No.: 09/178,246

[22] Filed: Oct. 23, 1998

Related U.S. Application Data

[60] Provisional application No. 60/083,085, Apr. 27, 1998.

[51] Int. Cl.[7] ..... F01P 1/04

[52] U.S. Cl. ..... 123/193.6; 123/73 AA; 92/184

[58] Field of Search ..... 123/193.6, 73 AA; 92/181, 181 P, 183, 184

[56] References Cited

U.S. PATENT DOCUMENTS

| | | | |
|---|---|---|---|
| 3,132,633 | 5/1964 | Zimmerman | 123/193.6 |
| 3,897,769 | 8/1975 | Jozlin . | |
| 4,092,967 | 6/1978 | Haslett . | |
| 4,501,239 | 2/1985 | Bauer et al. . | |
| 4,509,409 | 4/1985 | Reeves | 98/181 P |
| 4,660,383 | 4/1987 | Leonard . | |
| 4,719,846 | 1/1988 | Langstroth | 92/181 R |
| 4,942,804 | 7/1990 | Matsuura . | |
| 5,379,732 | 1/1995 | Mavinahally et al. | 123/73 AA |
| 5,645,028 | 7/1997 | Matsuoka . | |
| 5,947,065 | 9/1999 | Bing et al. | 123/193.6 |

*Primary Examiner*—Marguerite McMahon
*Attorney, Agent, or Firm*—John M. Harrison

[57] ABSTRACT

A ported piston for increasing the cylinder displacement of internal combustion engines which includes, in a first embodiment, an inertia-activated wafer provided in a cavity located in the piston, with one or more ports connecting the bottom of the cavity to the engine cylinder and typically provided with a check valve and one or more ports connecting the upper section of the divided cavity to the underside of the piston. In a second embodiment the cavity is annular in shape and receives a wafer ring and in a third embodiment the annular cavity and wafer ring, as well as the port or ports, are provided in an insert that seats in an opening provided in the top of the piston. The wafer and wafer ring move up and down by inertia in the cavity and cavity ring opening, respectively, to effectively increase the cylinder displacement and efficiency of the engine.

20 Claims, 3 Drawing Sheets

FIG. 1
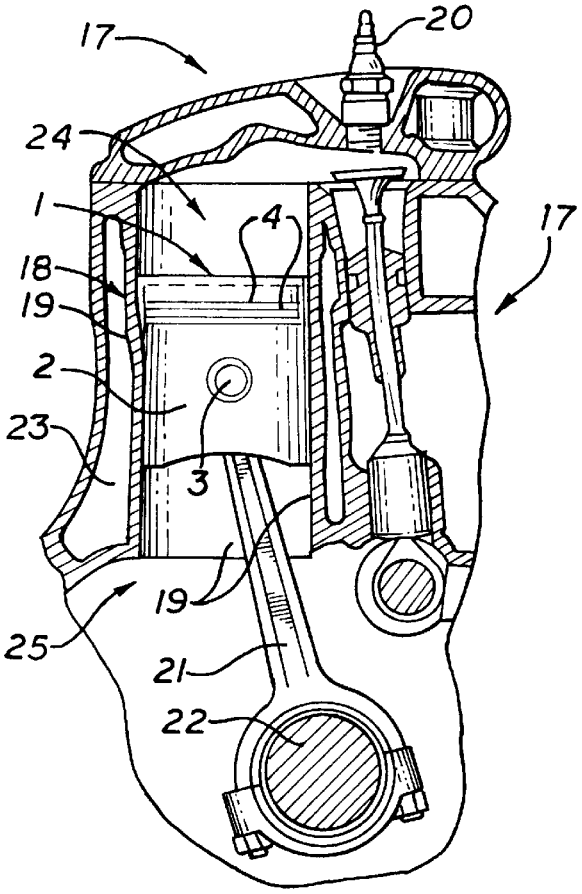
FIG. 3
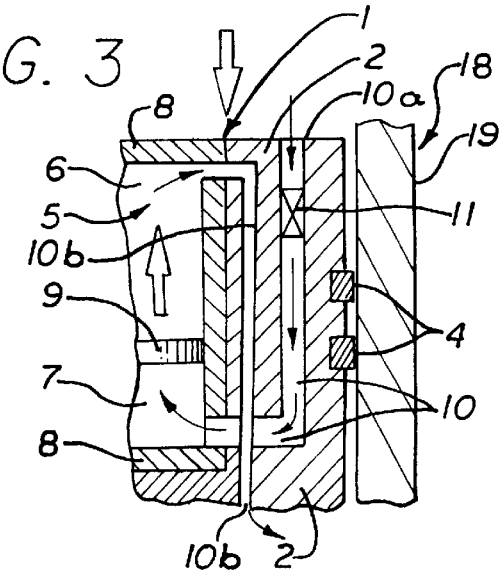
FIG. 4
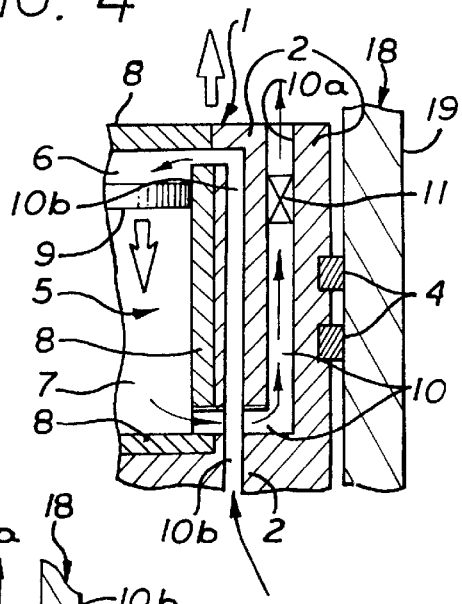
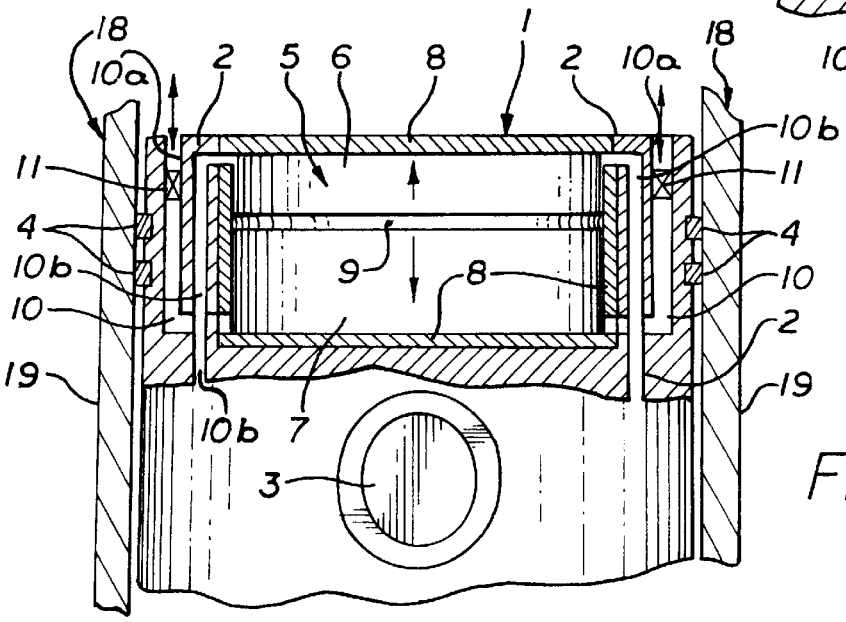
FIG. 2

PORTED PISTON

CROSS-REFERENCE TO RELATED APPLICATIONS

This application claims the benefit of copending U.S. Provisional Application Ser. No. 60/083,085, filed Apr. 27, 1998.

BACKGROUND OF THE INVENTION

1. Field of the Invention

This invention involves increasing the cylinder displacement of a piston driven, internal combustion engine and more particularly, to increasing cylinder displacement and engine efficiency by providing a ported piston having a cavity designed to receive a fuel charge and fitted with an inertia-activated, "floating" wafer or wafer ring which acts as a fuel-charging device during engine operation.

A long-standing goal of internal combustion engine designers is to increase horsepower per cubic inch of cylinder displacement. Since the burning of more fuel equates to more energy, and therefore, greater engine horsepower, a simple method of achieving this result is to increase the size of the engine pistons and cylinders. While this expedient does increase the horsepower by increasing the quantity of fuel introduced into the cylinders, the size of the engine must also proportionately increase with the increase in size and/or number of cylinders. Accordingly, the total weight of the engine also increases and at some point there is an engine operating efficiency trade-off, depending upon engine application.

There are other ways to increase the horsepower of internal combustion engines. One of these methods is to reduce the unfilled area above the piston at its maximum upward stroke, thereby creating a higher compression ratio. In another technique the crown of the piston is enlarged and while this does increase the compression ratio, the volume of the cylinder is reduced.

The ported piston of this invention increases engine displacement in an internal combustion engine without the trade-off deficiencies noted above. Each reciprocating piston has within it a cavity which accepts a charge of fuel during the intake stroke of the well known engine Otto cycle. The ported piston design of this invention includes an internal, inertia-activated, cavity-dividing device, hereafter referred to as a wafer or wafer ring, located in a cavity within the piston. The wafer or wafer ring is designed with tolerances supporting its role as a fuel-charging device and is actuated by its own inertia during piston reciprocation. The bottom of the cavity includes one or more ports configured to vent the cylinder-enlarging cavity through the top of the piston into the cylinder through one or more inertia-sensitive check valves located in the port or ports. The top section of the divided cavity has one or more ports configured to vent the top section of the cavity to the underside of the piston.

2. Description of the Prior Art

U.S. Pat. No. 3,897,769, dated Aug. 5, 1975, to Joseph A. Jozlin, details "Secondary Combustion Chambers For Internal Combustion Engines". The secondary combustion chambers of this invention are formed by a cavity lying adjacent to the primary combustion chamber. The secondary chamber communicates by means of one or more ports with the primary chamber and is supplied with a fuel-air mixture that is ignited and exhausted. U.S. Pat. No. 4,092,967, dated Jun. 6, 1978, to Robert A. Haslett, details "Internal Combustion Engines". In this engine the major part of the combustion chamber of each cylinder includes a recess formed in the piston crown and a catalytic element of mesh, grid perforated, or sintered construction is carried by the piston, the fuel and air mixture being injected into the recess to contact and pass through the catalytic element, where it is ignited by the catalytic element. U.S. Pat. No. 4,501,239, dated Feb. 26, 1985, to Friedrich Bauer, et al, details an "Air-Compressing, Direct-Injection Internal Combustion Engine". The piston of this engine is formed with a combustion chamber in the shape of a solid of revolution and includes a constricted throat opening where a fuel-air mixture formation is injected, predominantly by fuel deposition on the walls of the combustion chamber. U.S. Pat. No. 4,660,383, dated Apr. 28, 1987, to Gary L. Leonard, details a "Clean Air Blow-By System For Diesel Engine". In this engine, clean air is blown past compression ring seals to prevent particulate matter in combustion gases from entering between a cylinder wall or liner and a piston sidewall. A chamber is also disposed in the piston and includes a port substantially centered on the piston crown and a blow-by port on the piston sidewall bounded by the two compression ring seals. U.S. Pat. No. 4,942,804, dated Jul. 24, 1990, to T. Matsuura, et al, details a "Piston With A Ceramic Insert That Covers Piston Head Portion Defining Cavity". The piston head has a cavity and a central projection extending into the cavity. A ceramic insert is cast in a piston body to cover a piston head portion defining the cavity, except the central projection and its adjacent piston head projection. U.S. Pat. No. 5,645,028, dated Jul. 8, 1997, to Matsuoka, et al, details a "Piston Structure With A Combustion Chamber". The combustion chamber structure has a combustion chamber almost at the center of the piston and is installed in a cavity formed in the piston body, with a heat-insulating layer interposed therebetween. The combustion chamber structure is formed with a nozzle insertion hole and communication holes. A rich-air fuel mixture is generated in the upper part of the combustion chamber and the mixture is quickly injected into the cylinder chamber to produce the combustion.

It is an object of the present invention to provide a new and improved ported piston for increasing the cylinder displacement of internal combustion engines, wherein the ported piston includes a cavity or cavity ring opening fitted with an inertially-operating wafer or wafer ring to increase engine cylinder displacement, and thus the engine operating efficiency and horsepower.

Another object of the invention is to provide a new and improved piston design for enlarging the cylinder displacement of internal combustion engines, which design includes a cavity located in the piston, at least one port having an inertia-sensitive ball, gate or seal in a check valve for connecting the cavity to the engine cylinder, at least one port connecting the top section of the divided cavity to the underside of the piston and a "floating" or suspended wafer provided in the cavity, which wafer divides the cavity and "floats" by its own inertia in the cavity and charges fuel in the cavity throughout the engine Otto cycle.

A still further object of this invention is to provide a ported piston for increasing the cylinder displacement, efficiency and horsepower of internal combustion engines, which ported piston includes a piston cavity or cavity ring opening provided with a wafer or wafer ring that divides the piston cavity or cavity ring opening horizontally and at least one port connecting the bottom portion of the piston cavity or cavity ring opening with the top of the piston and the engine cylinder and an inertia and pressure-operated check valve utilizing a "floating" ball, gate or seal in the port, wherein the ball, gate or seal also "floats" by its own inertia and regulates air-fuel and exhaust flow responsive to operation of the engine through the four cycles of intake, compression, power and exhaust. The piston also includes at least one port connecting the top section of the divided cavity to the underside of the piston for pressure relief and lubrication purposes.

Still another object of the invention is to provide a new and improved ported piston for increasing the displacement of an internal combustion engine and fitted with a ring-shaped or annular cavity provided with a wafer ring that "floats" in the cavity according to its own inertia during the engine strokes or cycle, wherein at least one port has an opening adjacent to the bottom of the ring-shaped, annular cavity and extends through the top of the piston to communicate with the piston cylinder. A check valve having an inertia-sensitive ball, gate or seal, such as a closure flap, may be provided in the port to control wafer ring-compressed fuel-air mixture entry and exit from the ring-shaped cavity. The cavity has at least one other port connecting the top section of the divided cavity to the underside of the piston.

Still another object of this invention is to provide a ported piston for increasing the displacement of an internal combustion engine, which ported piston includes an insert cavity in the top thereof designed to receive a piston insert, also having a cavity that receives a wafer or a ring-shaped or annular cavity fitted with a wafer ring. The wafer and ring "float" according to inertia during engine operation to charge and expel fuel. Further included is at least one check-valved port connecting the bottom portion of the cavity or ring-shaped, annular cavity with the top of the piston and the cylinder to access the fuel. The divided cavity also typically contains at least one other port connecting the top section of the divided cavity to the underside of the piston.

SUMMARY OF THE INVENTION

These and other objects of the invention are provided in a new and improved ported piston for increasing the cylinder displacement of internal combustion engines. The ported piston includes, in a first preferred embodiment, a wafer provided in a cavity located in the piston, with at least one valved port having an inertia-sensitive check valve ball, gate or seal connecting the bottom of the cavity with the top of the piston and the engine cylinder and at least one other pressure relief port connecting the top section of the divided cavity to the underside of the piston. In a second embodiment of the invention the cavity is annular or ring-shaped and accommodates a wafer ring, wherein the check-valved port connects the bottom portion of the annular cavity with the top of the piston and the engine cylinder and at least one pressure relief port connects the top section of the divided cavity to the underside of the piston. In a third embodiment of the invention the piston is designed to receive an insert, which insert is provided with an annular or ring-shaped cavity fitted with a wafer ring and at least one port extending from the bottom of the annular cavity to the top of the piston and communicating with the cylinder and at least one pressure relief port connecting the top section of the divided cavity with the underside of the piston. In each case, the wafer and wafer ring operate by inertia to charge and expel fuel during engine operation.

BRIEF DESCRIPTION OF THE DRAWINGS

The invention will be better understood by reference to the accompanying drawings, wherein:

FIG. 1 is a sectional view of a segment of a typical internal combustion engine fitted with an engine cylinder, wherein the ported piston of this invention is seated in the cylinder and is mounted on a connecting rod attached to a conventional crankshaft in the engine;

FIG. 2 is an enlarged sectional view, partially in section, of a preferred embodiment of the upper portion of the ported piston illustrated in FIG. 1;

FIG. 3 is an enlarged view of the piston vent ports and pressure relief ports provided in the ported piston illustrated in FIG. 2, more particularly illustrating charging of a fuelair mixture into the bottom portion of the piston cavity and travel of an air/oil mist from the top section of the piston cavity into the area of the underside of the piston;

FIG. 4 is an enlarged view of a piston vent port and pressure relief port illustrated in FIG. 2, more particularly illustrating discharge of the fuel from the piston cavity and into the combustion chamber and travel of an air/oil mist to the top section of the piston cavity from the area under the piston;

DESCRIPTION OF THE PREFERRED EMBODIMENTS

Figure 5:
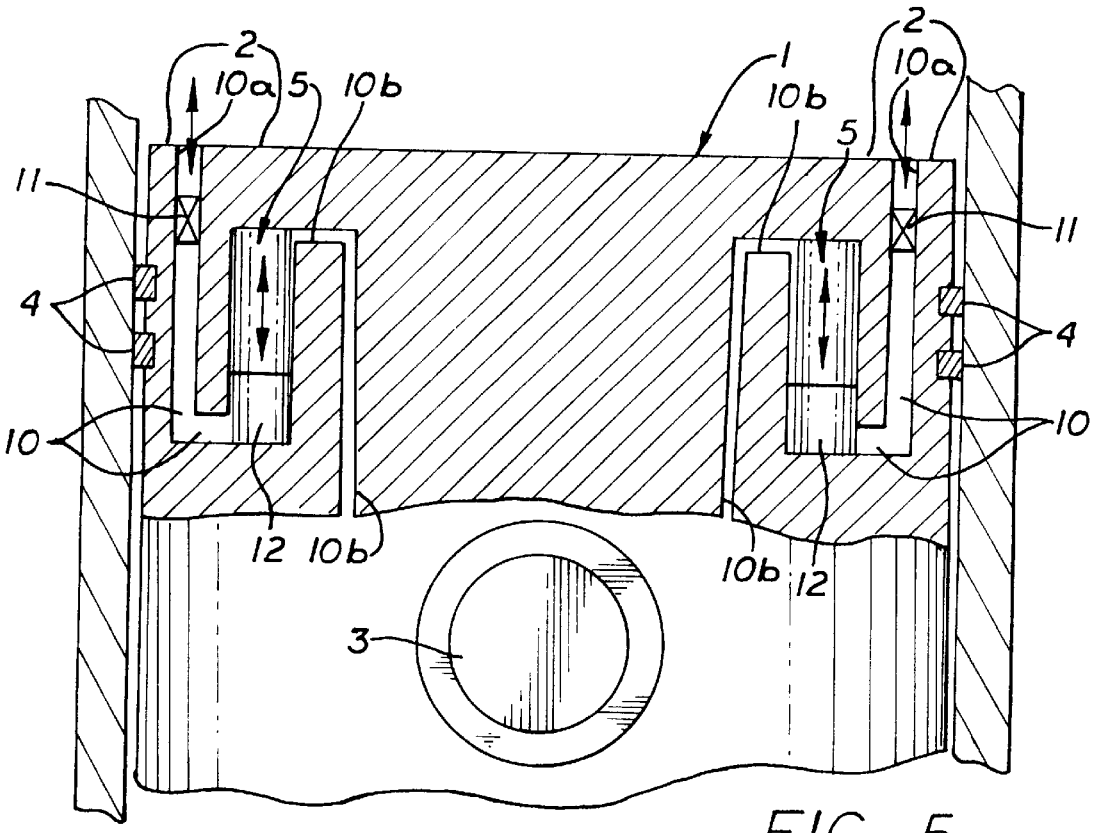
FIG. 5 is an enlarged sectional view of an alternative preferred embodiment of the ported piston illustrated in FIG. 1, wherein the piston cavity defines an annular or ring-shaped space or cavity in the piston and the wafer is characterized by a wafer ring vertically slidably positioned in the annular cavity.
Figure 6:
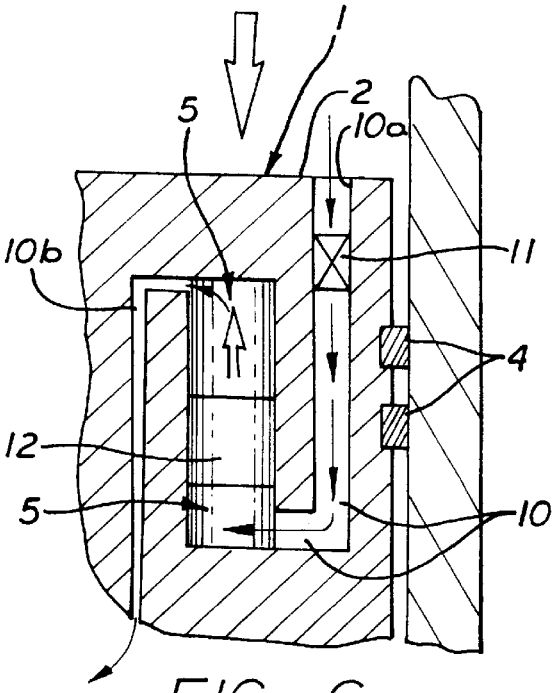
FIG. 6 is an enlarged view of one of the piston ports illustrated in FIG. 5, more particularly illustrating charging of a fuel-air mixture into the piston cavity and flow of an air/oil mist from the top section of the piston cavity to the area below the piston.
Figure 7:
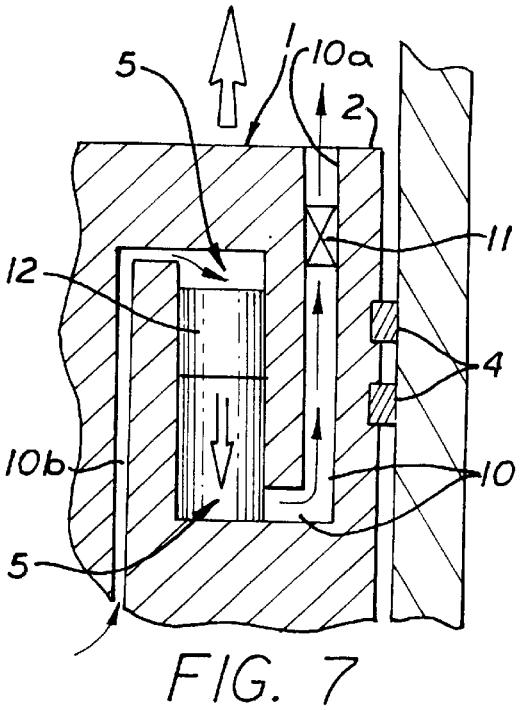
FIG. 7 is a sectional view of the port illustrated in FIG. 5, more particularly illustrating discharging of fuel from the piston cavity into the combustion chamber and flow of an air/oil mist into the top section of the piston cavity from the underside of the piston.

Referring initially to FIGS. 1–4 of the drawings, in a first preferred embodiment the ported piston of this invention is generally illustrated by reference numeral 1. The ported piston 1 is seated in reciprocating fashion in the cylinder 18 of an internal combustion engine 17. A combustion chamber 24 is defined in the cylinder 18 above the ported piston 1 and the ported piston 1 is caused to reciprocate in the cylinder 18 by means of a connecting rod 21, attached at one end to the ported piston 1 by means of a wrist pin 3 and connected at the opposite end to a crankshaft 22 located under the ported piston 1. A water jacket 23 serves to circulate water around the cylinder 18 and cool the internal combustion engine 17 and a spark plug 20 communicates with the combustion chamber 24 to effect the desired explosion of a fuel-air mixture introduced into the combustion chamber 24. The cylinder 18 is characterized by a cylindrical cylinder wall 19 and the cylindrical piston wall 2 of the ported piston 1 is slidably sealed in the cylinder 18 by means of piston rings 4, as further illustrated in FIG. 1.

Referring now to FIGS. 1 and 2 of the drawings, in a first preferred embodiment of the invention the ported piston 1 is characterized by a piston cavity 5, which is located in the upper end of the ported piston 1 and is divided to define a top cavity segment 6 and a bottom cavity segment 7, by means of a disc-shaped wafer 9. The wafer 9 is designed to "float" in the piston cavity 5 by its own inertia and charge and expel fuel as the internal combustion engine 17 operates, as hereinafter further described. Accordingly, it will be appreciated by those skilled in the art that the clearance between the peripheral edge of the wafer 9 and the vertical portion of the cavity wall 8 of the piston cavity 5 is such that adequate sealing is provided; however, the wafer 9 moves upwardly and downwardly by inertia in the piston cavity 5 responsive to reciprocating operation of the ported piston 1 in the internal combustion engine 17, as hereinafter further described. A pair of ports 10 are typically provided in the piston wall 2, which ports 10 communicate at one end with the bottom cavity segment 7 of the piston cavity 5 and the opposite end of the ports 10 are open to the top of the ported piston 1 and communicate with the combustion chamber 24 at the vents 10*a*. Additional pressure relief ports 10*b* are typically provided in the piston wall 2 and communicate from the top of the segment 6 of the piston cavity 5 to the underside of ported piston 1. The pressure relief ports 10*b* provide back pressure relief to the wafer 9 as it travels toward the top of the piston cavity 5. The pressure relief ports 10*b* also provide lubrication and sealant medium to the inner face between the wafer 9 and the vertical portion of the cavity wall 8, as oil droplets are transferred from beneath the ported piston 1, through the pressure relief ports 10*b* and into the top cavity segment 6, as hereinafter described. Oil volume may be controlled by specific sizing of port 10*b* to the configuration of the specific engine design and/or use of demister packing in the port. Furthermore, a check valve 11 is provided in each of the ports 10 to facilitate a flow of fuel into the bottom cavity segment 7 of the piston cavity 5 and exhaust fuel from the bottom cavity segment 7 during operation of the internal combustion engine 17, as further hereinafter described.

Referring now to FIGS. 1 and 5 of the drawings, in an alternative embodiment of the invention the piston cavity 5 is arranged in an annular or ring-shaped space in the upper segment of the piston wall 2 and receives a wafer ring 12, as illustrated. The ports 10 receive check valves 11 and communicate at one end with the bottom portion of the piston cavity 5 and extend upwardly at the opposite end to vent at the upper portion of the piston wall 2 at the vents 10*a* and communicate with the combustion chamber 24. The pressure relief ports 10*b* vent the top section 6 of cavity 5 to the underside 25 of the ported piston 1 as heretofore described with regard to FIG. 2.

Figure 8:
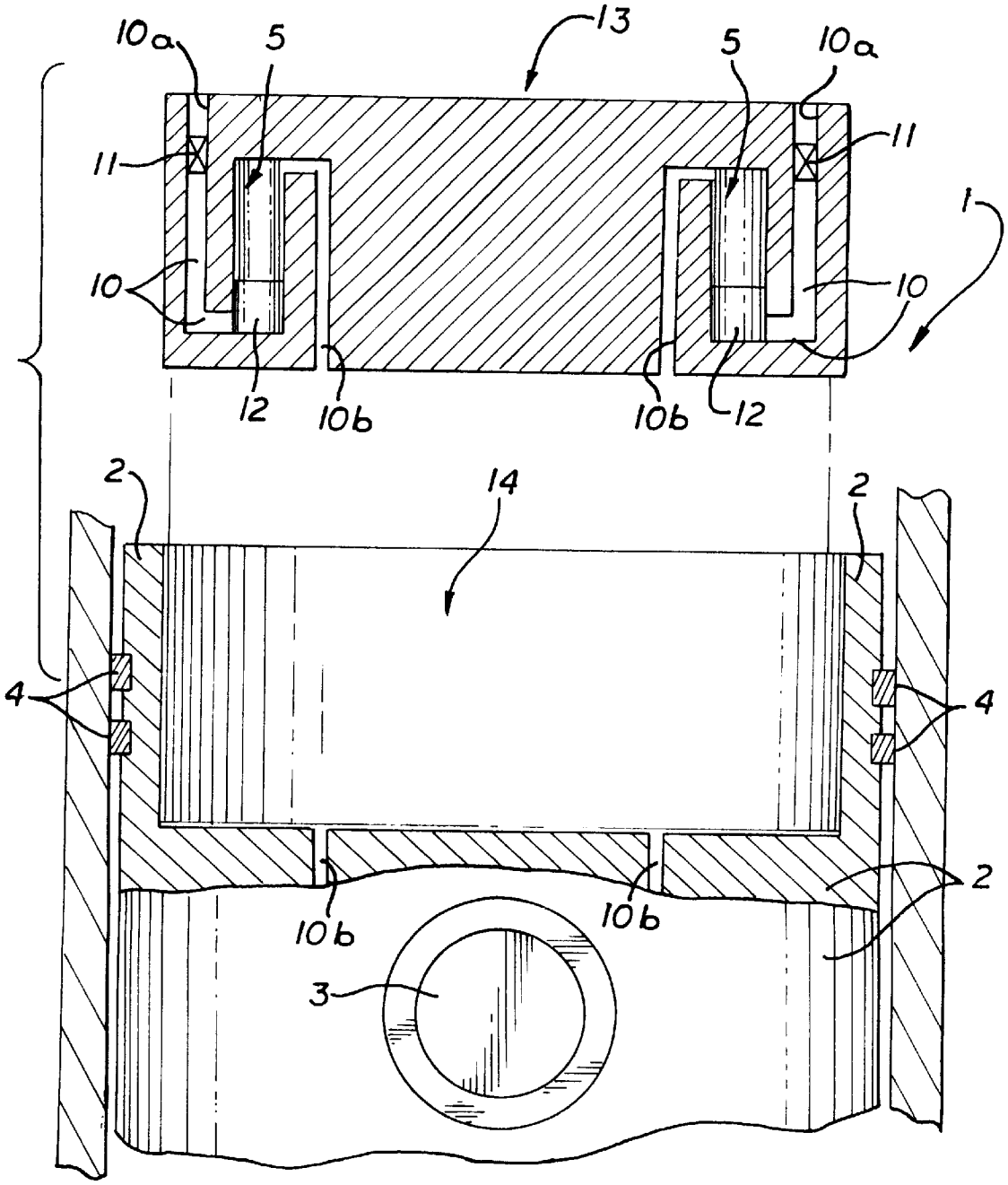
FIG. 8 is an exploded sectional view of another embodiment of the ported piston illustrated in FIG. 1, wherein a piston insert is seated in an insert seat located in the piston and the piston insert is characterized by an annular cavity or ring-shaped space fitted with an inertia-activated wafer ring and vents or ports having inertia-sensitive check valves, as well as pressure relief ports, for operation in the manner illustrated in FIGS. 5, 6 and 7.

Referring to FIG. 8 of the drawings, in another embodiment of the invention the piston cavity 5 accommodates a circular wafer ring 12 with ports 10, each having a check valve 11, and each of these elements is mounted in a piston insert 13, which seats in an insert seat 14, defined by the piston wall 2 of the ported piston 1. As described above with respect to FIGS. 1 and 5, the pressure relief ports 10*b* vent the top section 6 of the cavity 5 to the underside 25 of the ported piston 1.

In operation, the ported piston of this invention is described in the Otto cycle of a four-cycle internal combustion engine, which includes the power, fuel intake, compression and exhaust strokes, as illustrated in FIGS. 1, 3, 4, 6, 7 and 8 of the drawings.

POWER STROKE

Referring initially to FIGS. 1–4 of the drawings, a compressed fuel-air mixture is ignited by the spark plug 20 in the combustion chamber 24 as illustrated in FIG. 1, and the wafer 9 is situated in the bottom cavity segment 7 due to the inertia of the wafer's mass responsive to movement of the ported piston 1 upwardly from the bottom of the cylinder 18 to the top thereof. Ignition occurs slightly prior to top dead center of the ported piston 1, with the check valves 11 closed, since the check valve ball, flap, gate or alternative seal (not illustrated) is seated in or on the check valve seat (not illustrated), also due to the inertia of the upward-traveling ported piston 1. The sealing elements of the check valves 11 are designed to move or displace, like the wafer 9, in the opposite direction of ported piston 1 movement; this action is induced by the momentum of the ported piston 1 and the reaction of the inertia of the mass of the wafer 9 and the check valve sealing elements. As the ported piston 1 "breaks over" top dead center and begins to travel to the bottom of the cylinder 18 after combustion, the check valves 11 remain sealed due to the compression generated by the explosion of fuel in the cylinder 18. This action overcomes the inertia of the ball elements in the check valves 11, since the sealing elements would otherwise displace from the check valve seats and open the check valves 11. The cavity 5 and the ports 10 are static and cavity volume displacement is minimal during this downward stroke of the ported piston 1. Although the wafer 9 rises through the top cavity segment 6 toward the top of the cavity 5 as the ported piston 1 descends in the cylinder 18, the compression and suction effect of this action is ineffectual, as the check valves 11 are closed and there is no effective volume change in the cylinder 18. Any movement of air/oil vapor out of the segment 6 of the cavity 5 into the underside 25 of the ported piston 1 through the pressure relief ports 10*b* is inconsequential. The ported piston 1 is now located at the bottom of the cylinder 18. This movement of the wafer 9 is replicated by the wafer ring 12 in the respective piston cavities 5 of the alternative embodiments of the invention illustrated in FIGS. 5–8, respectively.

EXHAUST STROKE

As the ported piston 1 begins its return to the top of the cylinder 18, the wafer 9 is located on the bottom or floor of the piston cavity 5. The ports 10 and pressure relief ports 10*b* remain static as the check valves 11 are now closed due to the inertia of the check valve sealing elements when the ported piston travels upwardly. The ported piston 1 again reaches the top of its travel, pushing the exhaust gas ahead of it and from the cylinder 18. At the time of the directional change of the ported piston 1, any gases that may be trapped in the bottom cavity segment 7 below the wafer 9 are forced through the check valves 11 due to the pressure exerted by the falling wafer 9. The check valves 11 will immediately close due to the inertia of the ball or sealing elements. Any movement of air/oil vapor into the top section 6 of the cavity 5 from the area at the underside of the ported piston 1 through the pressure relief ports lob is inconsequential. The ported piston 1 is now located at the top of the cylinder 18. The wafer rings 12 track this movement of the wafer 9 in the embodiments illustrated in FIGS. 5–8, respectively.

FUEL INTAKE STROKE

During the next ported piston 1 travel sequence from the top of the cylinder 18 to the bottom, the wafer 9 is again lifted from the floor of the piston cavity 5 by inertia. The sealing elements in the check valves 11 are also displaced from their respective seats in the ports 10. The ports 10 are open to the vacuum action created by the lifting action of the wafer 9 and fuel is brought into the cylinder 18 and through the ports 10 and the now-open check valves 11, into the bottom cavity segment 7 of the piston cavity 5 in the ported piston 1. The gases in the top cavity segment 6 above the wafer 9 are pushed out through the pressure relief ports 10*b* into the underside area of the ported piston 1 as the wafer 9 travels to the top of the piston cavity 5 and the ported piston 1 travels to the bottom of the cylinder 18. The intake movement of the wafer rings 12, illustrated in FIGS. 5–8, respectively, is the same as the wafer 9.

COMPRESSION STROKE

The ported piston 1 then moves again toward the top of the cylinder 18, causing the wafer 9 to descend by inertia toward the bottom of the piston cavity 5 and pushes the contained fuel/air mixture from the bottom cavity segment 7 of the cavity 5, through the ports 10 and the open check valves 11, and out the top of the ported piston 1, into the cylinder 18. The vent 10*a* configuration of the ports 10 into the cylinder 18 may be parallel to the vertical plane of the piston as illustrated, or may be angled at a point above the check valves 11, as desired. Angling of the vents 10*a* will initiate a vortex flow of the gases into the cylinder 18, which can enhance flame propagation. As the ported piston 1 continues upwardly in the cylinder 18 in the compression stroke, seating of the sealing elements in the check valves 11 is overcome and the check valves 11 are opened by the pressure from the downward travel of the heavier wafer 9 (or the wafer rings 12 illustrated in FIGS. 5–8). Air/oil vapor is sucked into the segment 6 of the cavity 5 through the pressure relief ports lob. This action serves as a vacuum breaker and enhances travel of the wafer 9 to the bottom of cavity 5 and also provides lubrication and sealing to the interface between the wafer 9 and the cavity wall 8. Fuel-air flow takes place in the first movement of the ported piston 1 upwardly. At this point, the cylinder 18 is at its lowest pressure during the compression stroke; therefore, resistance pressure to the fuel exiting the ports 10 at the vents 10*a* is minimal. The ball, gate or sealing elements in the check valves 11 reseat after the pressure in the bottom cavity segment 7 of the piston cavity 5 is relieved and the ported piston 1 continues to the top of the cylinder 18, where ignition occurs once again. The wafer 9 or wafer rings 12 are now located in the floor of the respective piston cavities 5 and the cyclical process described above is then repeated.

It will be appreciated that the ported piston 1 can function without the use of a check valve or check valves 11 in the port or ports 10. However, efficiency will suffer under this design circumstance, to the extent that some exhaust gas will fill the bottom cavity segment 7 of the piston cavity 5 upon ignition. This event will reduce the compression ratio by the amount of the volume of the cavity area thus filled.

The volume of the fuel-air mixture flowing from the piston cavity 5 through the ports 10 into the cylinder 18 in the engine intake stroke is basically equal to the volume of the bottom cavity segment 7 below the wafer 9. This is the volume introduced into the bottom cavity segment 7 on the downward thrust of the ported piston 1 on the intake stroke. Accordingly, a key element of the invention requires that this volume be added to the "normal" displacement of the cylinder 18, "normal" being defined as that volume heretofore known as the area of displacement during a standard or conventional piston stroke in the cylinder 18. Considering an engine with a known compression ratio and horsepower, employment of the ported piston 1 of this invention will increase the cylinder displacement and therefore, the horsepower and efficiency of the engine. Accordingly, the same horsepower can be achieved with a smaller piston displacement using the ported piston of this invention. Smaller piston and cylinder displacement equates to a smaller engine and therefore, less weight, and this reduced weight increases the unit operating efficiency. Likewise, under circumstances where maximum horsepower is desired, the invention will provide additional power when the cylinder size cannot be increased due to engine weight and/or size limitations.

The material of construction of the wafer 9 and wafer ring 12 must be such that the wafer 9 and wafer ring 12 are able to withstand violent "slamming" against the top and bottom of the piston cavity 5. The material of choice can be metal, metal alloy or synthetic material and will depend upon the hardness and design of the critical areas of the ported piston 1, such as wrist pin reinforcement. Pistons which are cast or manufactured of soft metal may require the use of liners to act as reinforcement to the top and bottom of the piston cavity. Furthermore, wafer or wafer ring design need not be disc-shaped, as depicted in the drawings, but may be of any desired shape, such as a polygon, conforming to a correspondingly-shaped piston cavity. The "slamming" action of the wafer or wafer ring in the piston cavity is somewhat reduced due to the gas compressed beneath the wafer and wafer ring on the upward movement of the piston compression stroke and by the vacuum created below the wafer or wafer ring and by gases compressed above the wafer or wafer ring on the fuel-air intake stroke. This damping effect is assured by a close tolerance fit of the wafer or wafer ring edge to the cavity wall. Furthermore, the wafer can be constructed with a flared or thickened rim surface to provide additional contact surface with the cavity wall. Moreover, wafer or wafer ring guides can also be used within the cavity and the configuration of the top and bottom of the cavity is such that maximum surface area can be used in absorbing the impact energy of the wafer or wafer ring.

There are numerous possible configurations in the ported piston of this invention. For example, in addition to a polygonal shape, the ported piston can be configured to embody multiple, elongated cavities arranged in a pattern in the thicker sections of the piston. The cavities may each contain a sliding dividing object (wafer or wafer ring), that precisely fits the cavity bore in sliding relationship. The efficiency of such a system will depend upon the configuration and size of the cavity or cavities and the total volume of the cavity units. Unit or system ports and vents may or may not be connected to each other and the details of such a design will depend upon the size, structural material and allowable stresses in the ported piston.

The ported piston can be cast or molded with specifically designated areas to receive cavities and units or as an insert in the piston that can be filled and attached to the piston by methods known in the art. This design would allow inserts to be manufactured separately from the ported piston.

In addition to the increase in displacement of the engine, another system enhancement offered by the ported piston of this invention is that gas flow into and out of the ported piston cavities contributes to the cooling of the ported piston.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. A ported piston for increasing the displacement of an internal combustion engine having at least one cylinder, said ported piston comprising a piston disposed for reciprocation in the cylinder of the internal combustion engine; a cavity provided in said piston; at least one port provided in said piston for connecting said cavity to the cylinder; at least one pressure relief port connecting said cavity to the cylinder beneath said piston, for reducing back pressure in said cavity and providing lubrication in said cavity; and wafer means slidably disposed in said cavity for sequentially receiving fuel and exhaust gas in said cavity, charging the fuel in said cavity and removing the fuel from said cavity, responsive to reciprocation of said piston in the cylinder.

2. The ported piston of claim 1 comprising valve means provided in said port for selectively allowing the fuel to flow from the cylinder through said port into said cavity and from said cavity through said port into the cylinder.

3. The ported piston of claim 1 wherein said at least one port comprises two ports connecting said cavity to the cylinder and said at least one pressure relief port comprises two pressure relief ports connecting said cavity to the cylinder beneath said piston.

4. The ported piston of claim 3 comprising valve means provided in said ports for selectively allowing the fuel to flow from the cylinder through said ports into said cavity and from said cavity through said ports into the cylinder.

5. The ported piston of claim 1 wherein said cavity comprises a generally cylindrically-shaped cavity provided in said piston and said wafer means comprises a generally disc-shaped wafer slidably disposed in said cylindrically-shaped cavity.

6. The ported piston of claim 5 comprising valve means provided in said port for selectively allowing the fuel to flow from the cylinder through said port into said cavity and from said cavity through said port into the cylinder.

7. The ported piston of claim 5 wherein said at least one port comprises two ports connecting said cavity to the cylinder and said at least one pressure relief port comprises two pressure relief ports connecting said cavity to the cylinder beneath said piston.

8. The ported piston of claim 7 comprising valve means provided in said ports for selectively allowing the fuel to flow from the cylinder through said ports into said cavity and from said cavity through said ports into the cylinder.

9. The ported piston of claim 1 wherein said cavity comprises a substantially ring-shaped cavity provided in said piston and said wafer means comprises a generally ring-shaped wafer slidably disposed in said ring-shaped cavity.

10. The ported piston of claim 9 comprising valve means provided in said port for selectively allowing the fuel to flow from the cylinder through said port into said cavity and from said cavity through said port into the cylinder.

11. The ported piston of claim 9 wherein said at least one port comprises two ports connecting said cavity to the cylinder and said at least one pressure relief port comprises two pressure relief ports connecting said cavity to the cylinder beneath said piston.

12. The ported piston of claim 11 comprising valve means provided in said ports for selectively allowing the fuel to flow from the cylinder through said ports into said cavity and from said cavity through said ports into the cylinder.

13. The ported piston of claim 1 comprising insert means seated in said piston and wherein said cavity comprises a generally cylindrically-shaped cavity provided in said insert means and said wafer means comprises a generally disc-shaped wafer slidably disposed in said cylindrically-shaped cavity.

14. The ported piston of claim 13 comprising valve means provided in said port for selectively allowing the fuel to flow from the cylinder through said port into said cavity and from said cavity through said port into the cylinder.

15. The ported piston of claim 14 wherein said at least one port comprises two ports connecting said cavity to the cylinder and said at least one pressure relief port comprises two pressure relief ports connecting said cavity to the cylinder beneath said piston.

16. The ported piston of claim 1 comprising insert means seated in said piston and wherein said cavity comprises a substantially ring-shaped cavity provided in said insert means and said wafer means comprises a generally ring-shaped wafer slidably disposed in said ring-shaped cavity.

17. The ported piston of claim 16 comprising valve means provided in said port for selectively allowing the fuel to flow from the cylinder through said port into said cavity and from said cavity through said port into the cylinder.

18. The ported piston of claim 17 wherein said at least one port comprises two ports connecting said cavity to the cylinder and said at least one pressure relief port comprises two pressure relief ports connecting said cavity to the cylinder beneath said piston.

19. A ported piston for increasing the displacement of an internal combustion engine having at least one cylinder, said ported piston comprising a piston disposed for reciprocation in the cylinder of the internal combustion engine; a cavity provided in said piston; at least one port provided in said piston for connecting said cavity to the cylinder; check valve means provided in said port for selectively allowing fuel to flow from said cavity into the cylinder and from the cylinder into said cavity; at least one pressure relief port connecting said cavity to the cylinder beneath said piston for reducing gas pressure in said cylinder; and wafer means slidably disposed in said cavity for sequentially receiving fuel in said cavity, compressing the fuel in said cavity by inertia and removing the fuel from said cavity, responsive to reciprocation of said piston in the cylinder.

20. The ported piston of claim 1 wherein said cavity comprises a substantially cylindrically-shaped cavity provided in said piston and said wafer means comprises a generally ring-shaped wafer slidably disposed in said cylindrically-shaped cavity.

* * * * *